United States Patent [19]

Frick

[11] Patent Number: 4,621,000

[45] Date of Patent: Nov. 4, 1986

[54] EDGE STIFFENER FOR PLASTIC BAGS

[76] Inventor: Ursula Frick, Wilhelm Trübnerstrasse 16, D-6944 Hemsbach, Fed. Rep. of Germany

[21] Appl. No.: 751,668

[22] Filed: Jul. 3, 1985

[30] Foreign Application Priority Data

Jul. 6, 1984 [DE] Fed. Rep. of Germany ..... 3424885

[51] Int. Cl.[4] ..... B32B 1/04; B65D 33/02

[52] U.S. Cl. ..... 428/40; 383/33; 383/119; 428/83; 428/122; 428/172; 428/189; 428/192; 428/343

[58] Field of Search ..... 428/83, 40, 122, 192, 428/256, 343, 189, 172; 383/33, 119

[56] References Cited

U.S. PATENT DOCUMENTS

| | | | |
|---|---|---|---|
| 1,902,369 | 3/1933 | Krueger | 428/83 |
| 3,297,461 | 1/1967 | Siddall | 428/256 |
| 3,581,884 | 6/1971 | Caldwell | 428/40 |
| 3,915,528 | 10/1975 | Glickman | 428/40 |
| 4,379,519 | 4/1983 | Sherwood | 383/33 |
| 4,417,609 | 11/1983 | Sherwood | 383/33 |
| 4,443,283 | 4/1984 | Sarkisian | 428/40 |

*Primary Examiner*—Paul J. Thibodeau

*Attorney, Agent, or Firm*—Schwartz, Jeffery, Schwaab, Mack, Blumenthal & Evans

[57] ABSTRACT

An edge stiffening device for the openings of plastic bags, or the edges of sheets or similar materials comprising a band of stable, plastic material which is easily deformable by hand, said band having a longitudinally extending fold-line and being foldable into U-form. The surfaces of the band which form the inside of the U are provided with self-adhesive layers covered by releasable protective strips. The edge stiffener is plastically deformable by hand and can be used to give a plastic bag, sheet or similar material a stable edge having a desired configuration. To improve the stability of the form, the plastic band may be provided with one or more reinforcements, for example, of metal.

8 Claims, 4 Drawing Figures

EDGE STIFFENER FOR PLASTIC BAGS

BACKGROUND OF THE INVENTION

The present invention relates to an edge stiffener or margin reinforcement for the openings of plastic bags, the edges of plastic sheets, and the like.

A device for this general purpose is known from U.S. Pat. No. 4,379,519 in which a flexible plastic band is folded in U-form, placed over the edge of the opening of a bag and held there with clamps. Folding of such a plastic band is relatively difficult. Securing of the band by means of clamps is relatively expensive. Further, it is not possible to change the configuration of the opening of the bag to any desired configuration after the stiffener has been attached.

SUMMARY OF THE INVENTION

It is therefore the object of the invention to provide a new edge stiffening device for plastic bags, plastic sheets, and the like.

A further object of the invention is to provide an edge stiffening device for plastic bags which is easily foldable into U-form.

Yet another object of the present invention is to provide an edge stiffener for plastic bags which is easily attachable to the margins of the bag openings.

It is also an object of the present invention to provide an edge stiffener for plastic bags which enables the bag opening to be reshaped to any desired configuration after the edge stiffener has been attached to the bag.

These and other objects of the invention are achieved by providing an edge stiffener for the openings of a plastic bag, sheet or for a plastic or other similar material comprising a stable, easily deformable plastic band having a plasticity sufficient to be deformable by hand, said band having a longitudinally extending fold-line to facilitate folding thereof, and being foldable along its length into U-form to encompass the marginal edge of a bag, sheet or similar article, and the surfaces of said band which form the inner surfaces when the band is folded being provided with a tacky self-adhesive layer which will adhere to the material the edge of which is to be stiffened. The longitudinally extending fold-line facilitates folding of the band into U-form. The attachment of the band takes place in a simple manner by means of the self-adhesive layer. The plastic deformability of the plastic band makes it possible to form the bag opening to any desired shape.

In a preferred embodiment of the invention, a portion of the band bounded by the fold-line is provided with at least one embedded or attached reinforcement which preferably extends over the entire length of the band. The fold-line preferably lies in the center of the band and is defined by a groove pressed into the band in the side opposite the side provided with the self-adhesive layer.

The reinforcement may comprise a metal strip, a metal wire, or a metal mesh, and it is preferably disposed adjacent the fold-line. According to other preferred aspects of the invention the outer edges of the plastic band are bevelled or chamfered; substantially the entire surface of each of the inner surface portions of the band are coated with self-adhesive layers, and the self-adhesive layer on each portion of the band is covered with a releasable protective strip.

BRIEF DESCRIPTION OF THE DRAWINGS

The invention will be explained in further detail with reference to the accompanying drawings wherein.

DETAILED DESCRIPTION OF THE PREFERRED EMBODIMENTS

As used herein, the term "inner surface" of the band refers to the interior surfaces when the band is folded into U-form, and the term "outer surface" refers to an exterior surface when the band is folded into U-form.

Figure 1:
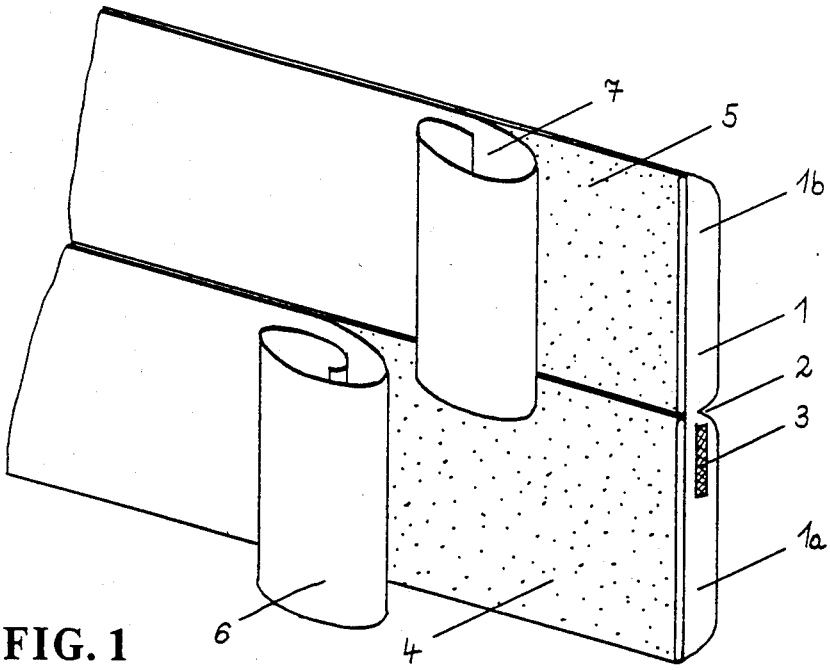
FIG. 1 is a perspective view, partially in section, of a first preferred embodiment of the invention.

The edge stiffener for plastic bags, sheets and the like illustrated in FIG. 1 is formed from a band 1 of plastic material which is stable, but also is sufficiently plastic that it is easily deformable by hand. Suitable deformable plastic materials are known to persons skilled in the plastics art. A fold-line 2 is pressed into the outside surface of the plastic band extending along the length of the band. Fold-line 2 facilitates ready inward folding of the band to have a U-form cross-section. In the illustrated embodiment, the fold-line is defined by a longitudinal groove disposed exactly in the middle of outer surface of the band, but it is understood that, if desired, the fold-line could be displaced toward one or the other edge of the band. The fold-line divides the band into two band portions, 1*a* and 1*b*. In band portion 1*a*, which is bounded by the fold-line, a longitudinally extending bendable reinforcement 3 is embedded adjacent the fold-line 2. This bendable reinforcement is in the form of a metal strip, the strength or width of which depends upon the degree of deformability desired for the plastic band. Suitable ductile metal reinforcement materials are known in the art. Reinforcement 3 is firmly secured within the plastic band.

Figure 2:
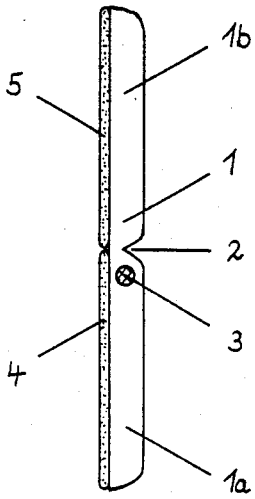
FIG. 2 is a cross-sectional view through a second preferred embodiment of the invention.
Figure 3:
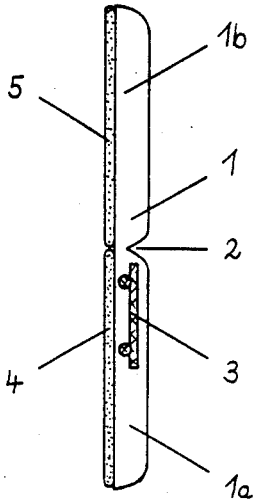
FIG. 3 is a cross-sectional view through a third preferred embodiment of the invention.

Alternatively, reinforcement 3 may take the form of a metal wire as shown in FIG. 2 or the form of a metal mesh as shown in FIG. 3, or any other form which lends a greater stability to the plastic band 1. It is also possible to use materials other than metal.

Figure 4:
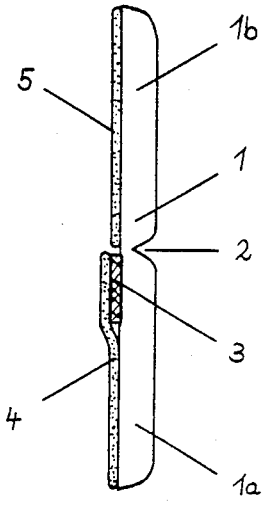
FIG. 4 is a cross-sectional view through a fourth preferred embodiment of the invention.

As an alternative to embedding the reinforcement in a portion of the plastic band, it is also possible to adhesively bond the reinforcement to the inner surface of the plastic band as shown in FIG. 4, or to otherwise attach the reinforcement to the band. Also, if desired, both band portion 1*a* and band portion 1*b* may be provided with reinforcements, although a single reinforcement is ordinarily sufficient.

The inner surfaces of both band portions 1*a* and band portion 1*b* are completely covered with tacky adhesive layers 4 and 5, respectively. Suitable adhesive materials are known to persons skilled in the adhesive art. It is also possible to provide adhesive over only a portion of the inside surface of each band portion so long as the adhesive is sufficient to assure satisfactory attachment of the band to the bag. Releasable protective strips 6 and 7 are provided to cover the tacky adhesive until it is time to apply the band to a bag or the like.

The device of the invention may be produced by conventional techniques known in the plastic forming art. To provide a smooth finished appearance, the outer edges 8 of the plastic band may optionally be chamfered or bevelled.

The application of the edge stiffener to a plastic bag takes place as follows:

A piece of edge stiffener is cut corresponding in length to the desired circumference of the bag opening plus an appropriate slight excess. Protective strip 6 is pulled off reinforced band portion 1*a*, and the band is formed into a ring with the adhesive layer 4 directed inwardly of a ring. The slight excess in the cut length referred to above allows the ends to overlap and be adhered to each other to form a ring. The outer margin of the plastic bag to which the edge stiffener is to be applied is adhered along the middle of plastic band 1 to the self-adhesive layer 4 and thus is attached to reinforced band portion 1*a*. If the circumference of the opening of the plastic bag is larger than desired, it can be adjusted to the desired dimension by folding or pleating.

After removing protective strip 7 from the unreinforced band portion 1*b*, this band portion is folded over inwardly and adhered by means by self-adhesive layer 5 to the inner marginal edge of the plastic bag the outer edge of which is already attached to the reinforced band portion 1*a*.

The edge of the plastic bag is thus stiffened and stabilized by means of the edge stiffener of the invention and can now be bent to the desired configuration by hand. The band of the invention is sufficiently rigid to assure that once the opening is bent to a desired configuration, the configuration will be retained until further bending force is applied.

The foregoing description has been set forth merely to illustrate the invention and is not intended to be limiting. Since modifications of the described embodiments incorporating the spirit and substance of the invention may occur to persons skilled in the art, the scope of the invention is to be limited solely with respect to the appended claims and equivalents.

What is claimed is:

1. A device for stiffening the edge of the opening of a plastic bag or similar material comprising a band of stable plastic material easily stably deformable by hand, said band being provided with a longitudinally extending fold-line to facilitate folding thereof, and being foldable along its length to U-form, the surfaces of said band which form the inner surfaces of the U when said band is folded to U-form being provided with a coating of tacky adhesive which will adhere to the material the edge of which is to be stiffened, said band being provided with at least one bendable reinforcement which is disposed adjacent the fold-line of the band and extended along its length, said reinforcement comprising a ductile material selected from the group consisting of a metal strip and a metal wire.

2. An edge stiffening device according to claim 1, wherein said fold-line is defined by a groove in the outer surface of said band.

3. An edge stiffening device according to claim 2, wherein said groove extends along the middle of said band.

4. An edge stiffening device according to claim 1, wherein said reinforcement is embedded in the band.

5. An edge stiffening device according to claim 1, wherein the reinforcement is adhered to the surface of the band.

6. An edge stiffening device according to claim 1, wherein the outer edges of said band are chamfered.

7. An edge stiffening device according to claim 1, wherein said adhesive layers extend over the entire inside surface of said band.

8. An edge stiffening device according to claim 1, wherein said adhesive layers are covered by releasable protective strips.

* * * * *